United States Patent [19]

Bonjour et al.

[11] Patent Number: 4,574,011

[45] Date of Patent: Mar. 4, 1986

[54] SINTERED ALLOY BASED ON CARBIDES

[75] Inventors: Christian Bonjour; Francois Duvanel, both of Nyon, Switzerland

[73] Assignee: Stellram S.A., Nyon, Switzerland

[21] Appl. No.: 586,790

[22] Filed: Mar. 6, 1984

[30] Foreign Application Priority Data

Mar. 15, 1983 [CH] Switzerland ..... 1421/83

[51] Int. Cl.[4] ..... C22C 19/03; C22C 19/07; C22C 28/00; C22C 29/02

[52] U.S. Cl. ..... 75/241; 75/236; 75/238; 75/245; 419/12; 419/13; 419/14; 419/15; 419/16

[58] Field of Search ..... 75/241, 236, 238, 245; 419/15, 12, 13, 14, 16

[56] References Cited

U.S. PATENT DOCUMENTS 3,245,763 4/1966 Ohlsson et al. ..... 75/241

FOREIGN PATENT DOCUMENTS

| | | |
|---|---|---|
| 44351 | 1/1982 | European Pat. Off. . |
| 1007185 | 5/1952 | France . |
| 2037801 | 12/1970 | France . |
| 2097258 | 3/1972 | France . |
| 2487380 | 1/1981 | France . |
| 517963 | 1/1965 | Switzerland . |
| 622041 | 4/1949 | United Kingdom . |
| 1282009 | 7/1972 | United Kingdom . |
| 2081741 | 2/1982 | United Kingdom . |

*Primary Examiner*—Allan M. Lieberman
*Attorney, Agent, or Firm*—Young & Thompson

[57] ABSTRACT

The alloy of the invention comprises 75 to 90% by weight of a mixture of carbides, for example WC and TiC, and 10 to 25% of a binder. This binder comprises Co, Ni and Ru, representing together 7 to 15% of the alloy, as well as $Mo_2C$. This alloy is useful for the production of decorative articles having a density similar to that of stainless steel.

8 Claims, No Drawings

SINTERED ALLOY BASED ON CARBIDES

The present invention relates to a sintered alloy based on carbides and comprising a binder, suitable for the production of decorative articles.

Alloys of sintered hard metal comprising at least a carbide and a metallic binder are already known on the one hand for the manufacture of cutting tools and on the other hand for the production of decorative articles. As regards more particularly this second utilization of such alloys, one may mention CH Pat. No. 517,963 which discloses the production of a watch case in a sintered hard metal based on carbides presenting excellent resistance characteristics to scratches thanks to its high hardness (higher than that of topaz). Furthermore, FR Pat. No. 2,487,380 and GB Pat. No. 1,282,009 respectively describe anti-abrasive sintered alloys based on carbides, nitrides and/or borides which contain in their binder at least a precious metal, for example Au, Ag, Pd or Pt, usable for the production of decorative articles resisting abrasion and presenting the aesthetical appearance of a precious metal.

The purpose of this invention consists in providing a sintered alloy of the above type, that is very hard, but presenting improved anti-corrosion properties and density near to that of stainless steel, especially in order to be able to replace this latter in the manufacture of unscratchable decorative articles such as watch cases and watchbands, bracelets and chains, lighters, pens, etc.

The sintered alloy based on carbides having a density near to that of steel, of the present invention and intended to achieve the above purpose, is characterized in that it comprises 75 to 90% by weight of a mixture of carbides, and 10 to 25% by weight of a binder, this binder comprising 60 to 70% by weight of Ni, Co and Ru, and 30 to 40% by weight of molybdenum carbide, and the Ru being present in a quantity of 10 to 25% of the whole of the three elements Co, Ni and Ru.

The mixture of carbides is preferably constituted of WC and TiC and can comprise, in replacement of a part of the carbides at least a nitride and/or at least a boride. Furthermore, the mixture WC—TiC can be also formed of a mixed compound of both carbides. Finally, $Mo_2C$ can eventually be partly replaced.by HfC.

The invention will now be illustrated by reference to the following examples.

EXAMPLE 1

Preparation of Alloys According to the Invention

The four following alloys have been prepared by pressing and sintering at a temperature comprised between 1350° and 1500° C. and at a relatively low pressure (0.1–1 Torr):

Alloy No. 1:
- 83% by weight of WC—TiC
- 12% by weight of Co, Ni, Ru
- 5% by weight of $Mo_2C$ Alloy No. 2:
- 83% by weight of WC—TiC
- 12% by weight of Co, Ni, Ru
- 3% by weight of $Mo_2C$
- 2% by weight of HfC Alloy No. 3:
- 90% by weight of WC—TiC
- 7% by weight of Co, Ni, Ru
- 3% by weight of $Mo_2C$ Alloy No. 4:
- 75% by weight of WC—TiC
- 15% by weight of Co, Ni, Ru
- 10% by weight of $Mo_2C$ (in the above alloys Nos. 1 and 2, the mixture of carbides contains 41.5% of WC and 41.5% of TiC, and the binder contains 2% of Co, 8% of Ni and 2% of Ru).

EXAMPLE 2

Hardness Tests and Density Measurement

The four alloys described in Example 1 have been subjected to a hardness test of type "Vickers-HV 10" according to "ISO 3768" standards. The results obtained are presented in the following table, together with the respective relative densities of these alloys:

| | "HV10" Hardness | Relative density |
|---|---|---|
| Alloy No. 1 | 1500 | 7.76 |
| Alloy No. 2 | 1520 | 7.79 |
| Alloy No. 3 | 1600 | 7.66 |
| Alloy No. 4 | 1400 | 7.97 |

EXAMPLE 3

Comparative Tests of Resistance to Corrosion

The four alloys Nos. 1 to 4 described in Example 1, as well as the four following reference alloys Nos. 5 to 8, have been subjected to corrosion tests.

Reference alloys Nos. 5 to 8: 83% of WC—TiC and 17% of binder, containing 5% of $Mo_2C$ and 12% of respectively Ni—Ru (alloy No. 5), Ni (alloy No. 6), Co (alloy No. 7) and Co—Ni (alloy No. 8).

The corrosion tests have been carried out under the following conditions:

(a) synthetic sea water
- conditions:
- room temperature
- humidity: 100%
- duration: 6 days
- cycle: 5 min. dipping every half an hour.

(b) saline mist
- conditions:
- synthetic sweat (formula BAM according to test of the Laboratoire Suisse de Recherches Horlogères)
- room temperature
- humidity: 100%
- duration: 6 days
- pieces (alloys) placed on a pad soaked with sweat Results obtained: in the three corrosion tests, the four alloys Nos. 1 to 4 (invention) remained unchanged, that is unaltered, whereas the four alloys Nos. 5 to 8 (reference) have been more or less strongly stained or corroded by the corrosion agents used.

EXAMPLE 4

Comparative Tests of Breaking Resistance

Test of resistance to rupture have been carried out according to standards "ISO 3327" for the four alloys Nos. 1 to 4 (invention) and the four reference alloys Nos. 5 to 8

The results obtained are mentioned in the following table:

TABLE

| Alloy No. | Breaking resistance (kg/mm$^2$) |
|---|---|
| 1 invention | 150 |
| 2 " | 150 |
| 3 " | 120 |
| 4 " | 170 |
| 5 reference | 145 |
| 6 " | 115 |
| 7 " | 125 |
| 8 " | 120 |

It results clearly from the above table that the alloys according to the invention have a resistance to rupture higher to that of the reference alloys (except for alloy No. 3).

EXAMPLE 5

Surface Condition

The state of surface of the alloys according to the invention (Nos. 1 to 4) and of the reference alloys (Nos. 5 to 8) has been examined, after polishing the specimens by means of a 1$\mu$ diamond paste, on the one hand by microscope observation and on the other hand by carrying out comparative tests of rugosity.

The metallographic observation with microscope of the polished surfaces revealed that the alloys according to the invention present an $A_oB_oC_o$ porosity (ASTM standards) and an average grain size of about 5 to 10$\mu$, whereas the reference alloys present an $A_1B_oC_1$ porosity and an average grain size below about 3$\mu$.

The rugosity tests have been carried out by means of a "Perthen M3A" apparatus with "PFK" advance unit ("cut-off" of 0.8 corresponding to a stroke of 4.8 mm).

For the alloys Nos. 1 to 4 (invention), the average values obtained were comprised between 0.05 and 0.1$\mu$, whereas for the alloys 5 to 8 (reference), they were of about 0.2 to 0.3$\mu$. This means that, under the same polishing conditions, the alloys according to the invention have a clearly lower rugosity than that of the reference alloys.

It appears from the various tests presented in the above examples that the sintered alloys according to the invention are particularly appropriate for the manufacture of decorative articles such as watch cases, watchbands, bracelets and chains, lighters, pens, etc.

As a matter of fact, these articles show a resistance to oxidation and to corrosion much greater than that of articles made of alloys of a similar type; this was unexpected and is due to the simultaneous presence of Co, Ni and Ru in the binder.

Furthermore, they have a high hardness (1400 to 1600), which make their polished surface unscratchable under normal use conditions of the articles considered, and a relative density (7.6–8.0) similar to that of a stainless steel (7.5–7.9).

Finally, the articles made of an alloy according to the invention present after polishing a remarkably brilliant surface. This property of being able to be polished shown by the alloys according to the invention is due to an average grain size after sintering which is larger than that of the known alloys. The quality of the surface brilliancy after polishing is results not only from the average grain size but also from the relatively low porosity of those alloys. The alloys according to the invention have thus porosity and average grain size values such that they allow obtaining an optimal compromise between the brilliancy or the brightness of the polished surface of these alloys, their hardness and their breaking resistance.

For the manufacture of articles, for example watch cases, the alloys according to the invention further present the advantage over the sintered hard metal alloys already used therefor to be obtainable by pressing and sintering at 1350°–1500° C. under a relatively low pressure (0.1–1 Torr), whereas said known alloys should be sintered at 1450°–1500° C. under a relatively high pressure (more than 1 Torr).

What we claim is:

1. Sintered alloy for use in the manufacture or ornamental articles and consisting essentially of 75 to 90% by weight of a mixture of carbides and 10 to 25% by weight of a binder, said binder consisting essentially of 60 to 70% by weight of Ni, Co and Ru, and 30 to 40% by weight of molybdenum carbide, and in which the Ru is present in a quantity of 10 to 25% of the whole of the three elements Co, Ni and Ru, the density of the alloy being 7.5 to 8.0.

2. Alloy according to claim 1, which is 83% of a mixture WC—TiC, 12% of Co, Ni and Ru, and 5% of $Mo_2C$.

3. Alloy according to claim 2, which is 2% of Co, 8% of Ni and 2% of Ru.

4. Alloy according to claim 2, which is 41.5% of WC and 41.5% of TiC.

5. Alloy according to claim 1, which is 90% of a mixture WC—TiC, 7% of Co, Ni and Ru, and 3% of $Mo_2C$.

6. Alloy according to claim 1, which is 75% of a mixture WC—TiC, 15% of Co, Ni and Ru and 10% of $Mo_2C$.

7. Alloy according to claim 1, in which in the mixture of carbides a part thereof is replaced by at least a nitride and/or at least a boride.

8. Alloy according to claim 1, in which the $Mo_2C$ of the binder is partly replaced by HfC.

* * * * *